US005868972A

United States Patent [19]

Galich et al.

[11] Patent Number: 5,868,972

[45] Date of Patent: Feb. 9, 1999

[54] AERATING DEVICE

[75] Inventors: Rostislav Anatolievich Galich; Jury Mikhailovich Meshengisser; Jury Grigorievich Marchenko; Viktor Andreevich Chernukha, all of Kharkov, Ukraine

[73] Assignee: Tovarischestvo S Organichennoi Otvetstvennostju "Ekopolimer", Belgorod, Russian Federation

[21] Appl. No.: 800,269

[22] Filed: Feb. 13, 1997

[30] Foreign Application Priority Data

Mar. 12, 1996 [RU] Russian Federation .. EA-96-0013-RU

[51] Int. Cl.[6] ..... B01F 3/04

[52] U.S. Cl. ..... 261/122.1; 261/124

[58] Field of Search ..... 261/122.1, 124, 261/DIG. 70

[56] References Cited

U.S. PATENT DOCUMENTS

| | | | |
|---|---|---|---|
| 2,682,827 | 7/1954 | Gressly | 261/124 |
| 3,186,644 | 6/1965 | Ross et al. | 261/124 |
| 3,880,965 | 4/1975 | Dudis et al. | 261/122.1 |
| 4,118,447 | 10/1978 | Richter | 261/122.1 |
| 5,013,493 | 5/1991 | Tharp | 261/124 |
| 5,560,875 | 10/1996 | Meshengisser et al. | 261/122.1 |

OTHER PUBLICATIONS

Advertising prospectus "Brandol area" of Messrs. Schumacher GmbH & Co.KG, Germany, 1989.

Advertising prospectus of firm "Ecopolymer" Ltd., Polymer articles at the service of ecology, 1994.

*Primary Examiner*—C. Scott Bushey

*Attorney, Agent, or Firm*—Collard & Roe, P.C.

[57] ABSTRACT

A device for the saturation of liquids with gases is described and makes it possible to compensate for temperature-dependent changes in the length of the string of the aerating device without affecting its intactness. The device includes an air conduit connected to coaxially arranged and tightly held together aerating modules each of which has a perforated tubular air distributor coaxially encompassed with a tubular dispersing element. The air distributor of at least one module is sectional as for length and is made up of three coaxial components. A central component of the three components is in fact a tubular perforated element having its ends extended, with a possibility of sliding reciprocatingly, in the respective ends of extreme components. The dispersing element of the module overlaps at least partially the zone of interconnection of the sectional air distributor.

1 Claim, 2 Drawing Sheets

AERATING DEVICE

FIELD OF THE INVENTION

The present invention relates in general to saturation of liquids with gases and more specifically, to an aerating device.

The invention can find application in systems for aeration of natural water and industrial sewage during its biological treatment, in floatation systems, for water chlorination, for air supply in water-and-air cleaning of the granular medium of filters used in treatment of natural and industrial sewage, and removal of filtered liquid after its treatment, as well as for soil drainage in land hydroamelioration.

BACKGROUND OF THE INVENTION

One state-of-the-art aerating device is known (cf. an advertising prospectus "Brandol area" of Messrs Schumacher GmbH & Co. KG, Germany, 1989) to comprise an air conduit connected to a tubular air distributor provided with radial holes arranged along one of the generatrices thereof. A separate cylinder-shaped dispersing element is held in place above each of said holes, said element being plugged at both ends.

The aforesaid aerating device features a high degree of dispersion of the compressed air fed into the liquid being aerated. However, provision of separate dispersing elements and a sophisticated construction of their attachment to the air distributor affects adversely the operating reliability of the aerating device, because compressed air can make its way into the liquid at the place of attachment of the dispersing element to the air distributor.

Another aerating device we have adopted as the prototype (cf. an advertising prospectus of the Scientific-and-production firm "Ecopolymer" Ltd., entitled "Polymer articles at the service of ecology", 1994) comprises a number of coaxially arranged aerating modules air-tightly held together, each comprising a polyethylene-made perforated tubular air distributor whose outer surface is provided with a double-layer coating of a polymer material, said coating forming a dispersing element. The vacant end of the first module air distributor is provided with a flange for connecting to an air conduit supplying compressed air to the interior of the aerating device air distributors. The dead end of the last module is provided with a blank plug which prevents compressed air against escaping from the interior of the air distributors.

The aerating device discussed hereinbefore operates efficiently when using a few aerating modules (not more than three) interconnected into a string. However, when a greater number of modules is used in a string of the aerating device, a considerable temperature difference of compressed air occurs from the first (relative to the air conduit) module to the last one. Furthermore, an ambient temperature difference is also possible during installation and operation of the aerating device. This in turn leads to thermal deformation of the air distributors interconnected into a string (that is, their elongation or shortening), with the resultant mechanical deformation and breakage of the air distributors, whereby the intactness of the dispersing coating is upset and hence the operation of the aerating as a whole is disturbed as well.

SUMMARY OF THE INVENTION

The present invention has for its principal object to provide a possibility of compensating for temperature-dependent changes in the length of the string of the aerating device without affecting the intactness thereof so as to render the operation of the device more reliable and retain a high degree of dispersion of air fed into the liquid being aerated.

The foregoing object is accomplished due to the provision of an aerating device, comprising:

- an air conduit for feeding compressed air to the aerating device;
- a plurality of aerating modules arranged in series coaxially with one another and air-tightly held together;
- a first aerating module out of said plurality of aerating modules, having its vacant end air-tightly connected to said air conduit;
- the last aerating module out of said plurality of aerating modules, its vacant end having a blank plug preventing compressed air from escaping the aerating device;
- each of said plurality of aerating modules having a perforated tubular air distributor and a dispersing element located outside said perforated tubular air distributor coaxially therewith;
- said air distributor of at least one of said plurality of aerating modules is sectional as for length and is made up of at least two coaxial components;
- a first of said components of said sectional air distributor;
- a second of said components of said sectional air distributor, disposed partially in said first component of said air distributor longitudinally movable relative thereto;
- the zone of joining together said first component and said second component of said sectional air distributor;
- said dispersing element adapted to overlap said joining zone.

In cases of temperature variations resulting in elongation or shortening of a string of said device, the abovedescribed construction arrangement of the aerating device enables the sections of the sectional air distributor to displace longitudinally with respect to one another without both mechanical breakage of the air distributors and disturbing the intactness of the dispersing element, thus making it possible to compensate for temperature-dependent changes in the string length, which adds much to the operating reliability of the aerating device and retains a high degree of dispersion of the air fed into the liquid being aerated.

When using the proposed aerating device under high-pressure conditions, which is the case in water-and-air cleaning of the granular medium of filters used in treatment of natural and industrial sewage, it is expedient that:

- said first component of said sectional air distributor has its end surface facing said second component and is provided with a recess;
- said second component of said sectional air distributor has its end surface facing said first component and is provided with a projection;
- said projection is fitted in said recess slidably in a longitudinal direction;
- a first clearance defined between said end surface of said first component free from said projection, and said end surface of said second component free from said recess.

The aforestated features provide for high strength of the string of the aerating device.

When the length of the aerating device is increased considerably, that is, when a string of the device incorporates more than ten modules, it is expedient, for accomplishing the foregoing object of the invention, that provision be made for:

an air conduit for feeding compressed air into the aerating device;

a plurality of aerating modules arranged in series coaxially with one another and air-tightly held together;

a first aerating module out of said plurality of aerating modules, having its vacant end air-tightly connected to said air conduit;

the last aerating module out of said plurality of aerating modules, its vacant end having a blank plug preventing compressed air from escaping the aerating device;

each of said plurality of aerating modules having a perforated tubular air distributor and a dispersing element located outside said perforated tubular air distributor coaxially therewith;

said air distributor of at least one of said plurality of aerating modules is sectional as for length and is made up of at least three coaxial components;

said first extreme component and said second extreme component of said three coaxial components, each being in effect a sleeve whose first end is threaded for being joined together with said next aerating module;

a central component of said three components, which is in fact a tubular perforated element having its ends extended, with a possibility of sliding reciprocatingly, in the respective second ends of said first and said second extreme components, said second ends facing said perforated element;

a clearance defined between at least one end of said central component and the end of said air distributor of said adjacent aerating module;

a first zone of joining said central component with said first extreme component;

a second zone of joining said central component with said second extreme component;

said dispersing element overlapping at least partially said first joining zone and said second joining zone.

Thus, the herein-proposed construction arrangement of the aerating device makes it possible to compensate for temperature-dependent changes in the length of the string thereof without mechanical breaks and damages, which adds much to the operating reliability of the aerating device and retains a high degree of dispersion of the air fed into the liquid being aerated.

BRIEF DESCRIPTION OF THE DRAWINGS

To promote understanding of the present invention, given below are some specific exemplary embodiments thereof with reference to the accompanying drawings, wherein.

DESCRIPTION OF THE PREFERRED EMBODIMENTS

Figure 1:
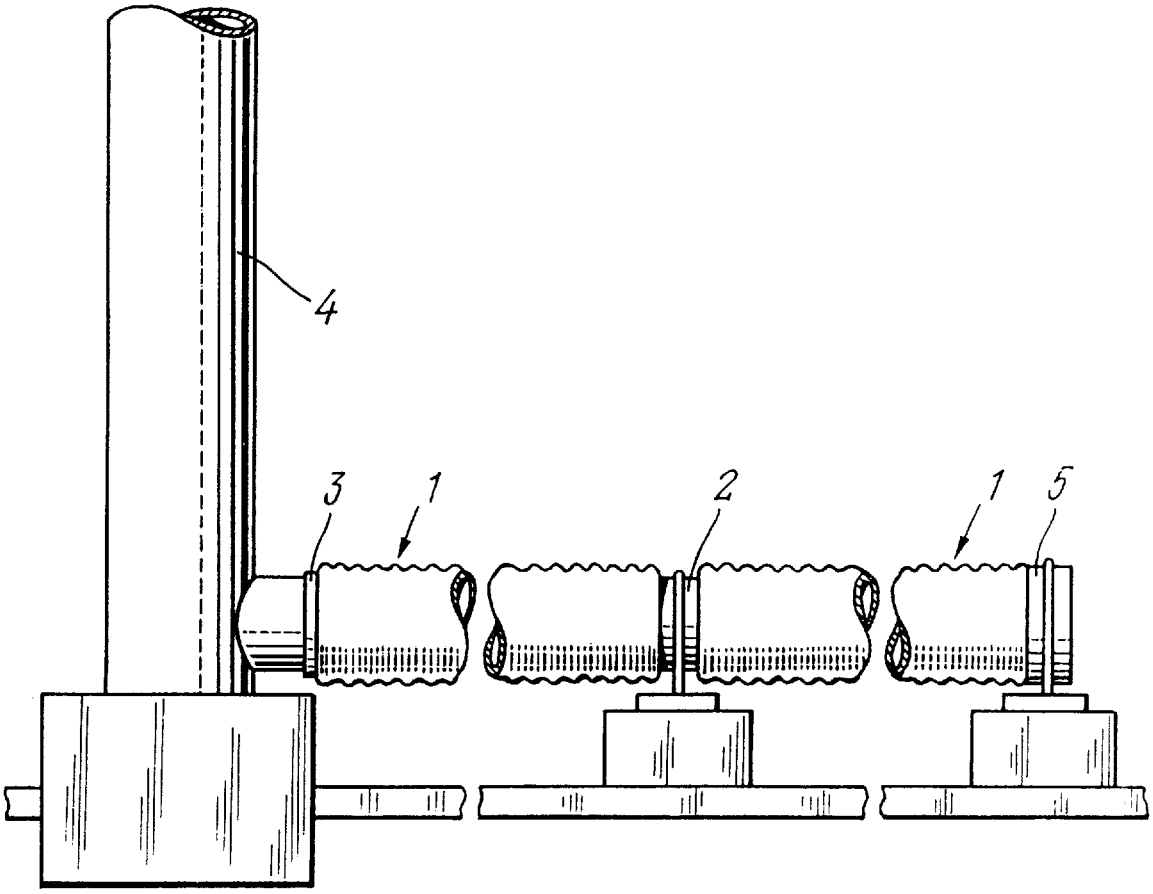
FIG.1 is a schematic side view of the aerating device, according to the invention.

Referring now to the accompanying drawing, FIG.1 presents a number of aerating modules 1 of the aerating device, according to the invention, said modules being joined together and attached to one another air-tightly, using any heretofore-known technique, e.g., by means of threaded sleeves 2. The modules mentioned above establish the string of the aerating device which is installed in an aeration tank (omitted in the drawing). The number of aerating modules depends on the dimensions of the aeration tank and on the preset rate of air feed, that is, the larger the tank dimensions and the higher the rate of air feed the greater number of aerating modules is required.

A blank plug 3 is provided at the vacant end of the first aerating module 1 of the string, said blank plug having a port for compressed air to feed to the aerating device from an an air conduit 4 which communicates with an air blower (omitted in the drawing). A blank plug 5 is provided at the vacant end of the last aerating module 1 of the string, said blank plug preventing compressed air against escaping from the aerating device.

Each of the aerating modules 1 comprises a tubular perforated air distributor 6 (FIG.2) made of, e.g., high-density linear polyethylene. It is the tubular air distributors having an inside diameter of about 0.1 m, a wall thickness of about 0.01 m, and a length of about 2 m that are used most extensively for making the aerating devices.

The outer surface of the air distributor 6 is provided with a double-layer porous coating made of, e.g.,low-density branched polyethylene, said coating forming a coaxial tubular dispersing element 7 outside the air distributor 6. The dispersing element 7 may be of any other heretofore-known construction, viz, it can be made as a single-layer porous coating, or a porous shell coaxial with the air distributor 6 and held to the latter on its outside, or else may have any other construction arrangement known heretofore. The external surface of the air distributor 6 may be either plain as shown in FIG.2, or finned for better air distribution over the surface of the air distributor 6.

The air distributor 6 of at least one aerating module 1 is made sectional as for length and is constituted by at least two coaxial components 8 disposed partially one in the other and longitudinally movable relative to each other. The dispersing element 7 of said module 1 overlaps at least partially a zone 9 of joining together the components 8 of the sectional air distributor 6. The number of aerating modules incorporating a sectional air distributor depends both on the length of the string of the aerating device and on a possible temperature variation of the compressed air fed. Thus, the greater the string length and the temperature variation the more modules should incorporate the sectional air distributor 6.

Figure 2:
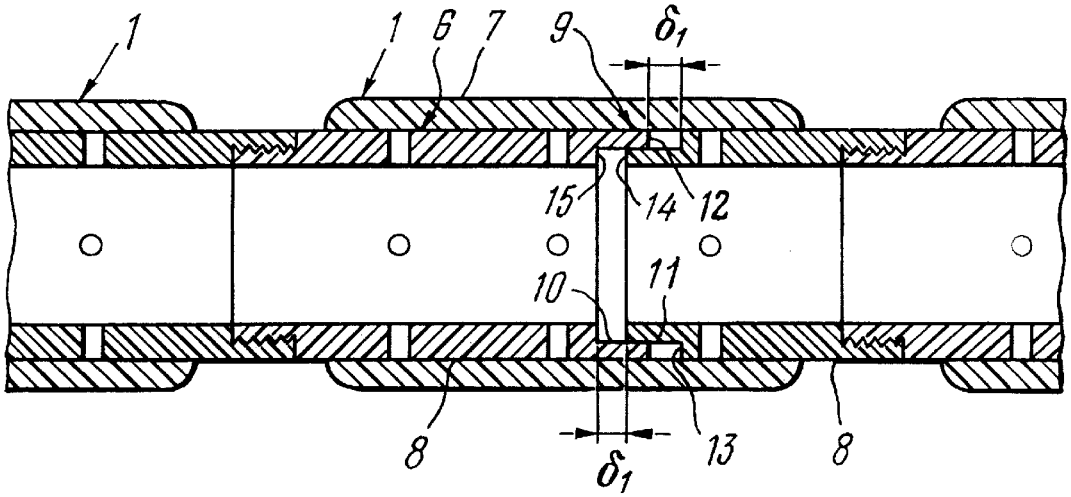
FIG.2 is an embodiment of the aerating device, comprising three joined-together modules, according to the invention.

FIG.2 presents an aerating device having a single sectional air distributor 6 which comprises two coaxial components 8. A recess 10 is made in the end surface of the first component 8, and a mating projection 11 is provided on the opposite face surface of the second component 8 of the sectional air distributor 6, said projection 11 engaging said recess slidably (with a sliding fit) and defining clearances 61 between opposite ends 12, 13, 14, 15 of said components 8. The amount of the clearances 61 is determined with due account of the temperature coefficient of linear expansion of the material the given air distributor 6 is made of.

Figure 3:
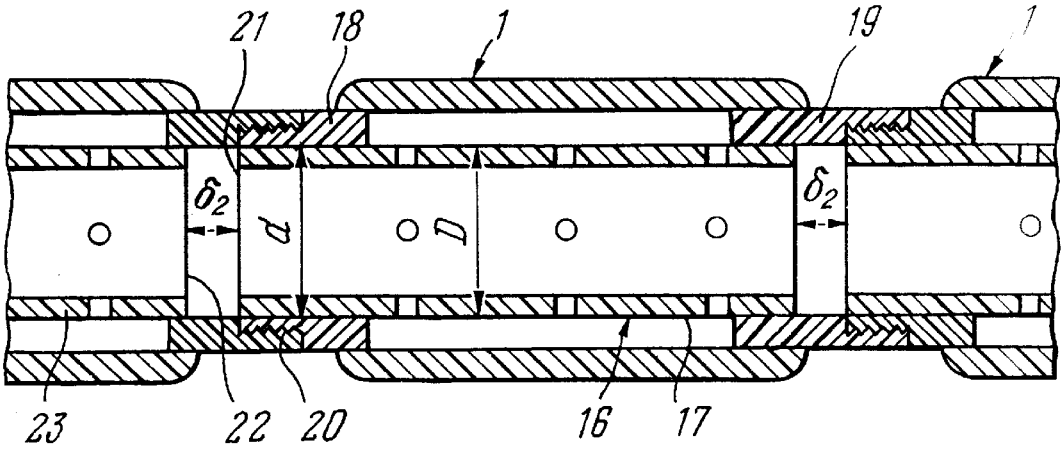
FIG.3 is an alternative embodiment of the aerating device of FIG.2.

FIG.3 displays an alternative embodiment of the herein-proposed aerating device. According to this embodiment, a sectional air distributor 16 comprises three coaxially arranged components 17, 18, and 19. The central component 17 is essentially a tubular perforated element, while the extreme components 18 and 19 are in effect sleeves provided a thread 20 for joining together with the adjacent aerating modules 1. The central component 17 has an outside diameter D substantially equal to the inside diameter (d) of each extreme component 18 and 19. The ends of the central component 17 are accommodated inside the ends of the extreme components 18, 19, said ends facing said central portion 17, with a possibility of performing longitudinal reciprocating sliding motion (by a sliding fit). A clearance 62 is defined between an end 21 of the central component 17 and an opposite end 22 of an air distributor 23 of the adjacent aerating module 1, said clearance being determined with due account of the temperature coefficient of linear expansion of the material the sectional air distributor 16 is made of. According to another embodiment of the present invention, any sectional air distributor may be constituted by a great number of sections, e.g., so as to integrate the construction of the devices presented in FIGS.2 and 3.

Thus, the fact that the air distributor 6, 16 is sectional as for length in the various embodiments thereof makes it possible to avoid mechanical deformation or breakage of all air distributors of the aerating device and disturbance of intactness of the dispersing elements thereof, thus rendering the operation of the aerating device more reliable and retaining a high degree of dispersion of the air fed into the liquid being aerated.

The aerating device of the present invention operates as follows.

Compressed air is fed from the air blower to the air conduit 4 on which it passes to the tubular perforated air distributors 6, 16 of the aerating modules 1 arranged in series and air-tightly held together. Then compressed air makes its way through the perforations in the air distributors 6, 16 into the dispersing elements 7, whereupon air escapes, in the form of fine bubbles, into the liquid being aerated. The compressed air temperature in the air conduit 4 is within 70° to 80° C. and tends to drop, as compressed air passes through the aerating modules 1, down to 20°–30° C., depending on the length of the string of the aerating device, the temperature of the liquid being aerated, and the depth at which the aerating device string is situated. Due to the resultant temperature difference the length of each tubular air distributor changes by a different value. In this case, provision of at least one air distributor 6, 16 sectional as for length enables the components 8, 17, 18, 19 thereof to displace longitudinally with respect to one another in the zone 9 of their joining-together without affecting the intactness of the air distributors and dispersing elements 7. This ensures against destruction of the aerating modules due to the presence of temperature stresses. Inasmuch as the dispersing element 7 of the sectional air distributor 6, 16 overlaps at least partially the zone 9 of joining-together of its components 8, 17, 18, 19, the variations in the amount of the clearances 61 and 62 do not affect the operation of the aerating device. That is, the degree of dispersion of the air fed into the liquid being aerated remains adequately high, nor the uniform distribution of air bubbles in the liquid being aerated is upset.

What we claim is:

1. An aerating device comprising:

an air conduit for feeding compressed air into the aerating device;

a plurality of aerating modules arranged in series coaxially with one another and air-tightly held together;

a first aerating module out of said plurality of aerating modules, having its vacant end air-tightly connected to said conduit;

the last aerating module out of said plurality of aerating modules, its vacant end having a blank plug preventing compressed air from escaping the aerating device;

each of said plurality of aerating modules having a perforated tubular air distributor and a dispersing element located outside said perforated tubular air distributor coaxially therewith;

said air distributor of at least one of said plurality of aerating modules is sectional along its length and is made up of at least three coaxial components;

a first extreme component and a second extreme component of said three coaxial components, each extreme component being in effect a sleeve whose first end is threaded for being joined together with said next aerating module;

a central component of said three components, which is in fact a tubular perforated element having its ends extended, with a possibility of sliding reciprocatingly, in the respective second ends of said first and said second extreme components, said second ends facing said perforated element;

a clearance defined between at least one end of said central component and the end of said air distributor of said adjacent aerating module;

a first zone of joining said central component with said first extreme component;

a second zone of joining said central component with said second extreme component;

said dispersing element overlapping at least partially said first joining zone and said second joining zone.

* * * * *